US008621826B2

(12) United States Patent
Wiersma

(10) Patent No.: US 8,621,826 B2
(45) Date of Patent: Jan. 7, 2014

(54) APPARATUS FOR ASSEMBLING MAIL PIECES

(75) Inventor: Jelle Wiersma, Drachtster Compagnie (NL)

(73) Assignee: Neopost Technologies, Bagneux (FR)

( * ) Notice: Subject to any disclaimer, the term of this patent is extended or adjusted under 35 U.S.C. 154(b) by 278 days.

(21) Appl. No.: 13/005,995

(22) Filed: Jan. 13, 2011

(65) Prior Publication Data

US 2011/0170925 A1 Jul. 14, 2011

Related U.S. Application Data

(63) Continuation-in-part of application No. 11/026,262, filed on Dec. 31, 2004, now abandoned.

(30) Foreign Application Priority Data

Dec. 31, 2003 (NL) ..... 1025163

(51) Int. Cl.
*B65B 61/20* (2006.01)

(52) U.S. Cl.
USPC ..... 53/284.3

(58) Field of Classification Search
USPC ..... 53/266.1, 284.3, 154; 700/220–224
See application file for complete search history.

(56) References Cited

U.S. PATENT DOCUMENTS

| | | | | |
|---|---|---|---|---|
| 4,582,312 | A | 4/1986 | Abrams et al. | |
| 5,283,752 | A | 2/1994 | Gombault et al. | |
| 5,680,742 | A * | 10/1997 | Hidding | 53/411 |
| 5,684,965 | A | 11/1997 | Pickering | |
| 5,774,885 | A * | 6/1998 | Delfer, III | 705/401 |
| 5,798,930 | A | 8/1998 | van Oosten | |
| 5,819,666 | A * | 10/1998 | Ishikawa et al. | 101/483 |
| 6,026,385 | A * | 2/2000 | Harvey et al. | 705/408 |
| 6,366,827 | B2 * | 4/2002 | Krasuski et al. | 700/220 |
| 6,779,319 | B2 * | 8/2004 | Smith et al. | 53/493 |
| 7,266,782 | B2 | 9/2007 | Hull et al. | |
| 7,475,362 | B2 * | 1/2009 | Fujiyoshi | 715/838 |
| 7,706,914 | B2 * | 4/2010 | Hayduchok | 700/224 |
| 8,109,067 | B2 * | 2/2012 | Chatte | 53/475 |
| 8,157,254 | B2 * | 4/2012 | DeWitt et al. | 270/52.01 |
| 2002/0078663 | A1 * | 6/2002 | Kramer et al. | 53/411 |
| 2002/0080376 | A1 * | 6/2002 | Momose et al. | 358/1.9 |
| 2002/0104782 | A1 * | 8/2002 | DeWitt et al. | 209/3.3 |
| 2003/0084647 | A1 | 5/2003 | Smith et al. | |
| 2003/0156479 | A1 * | 8/2003 | Fujiyoshi | 365/200 |
| 2003/0236680 | A1 * | 12/2003 | Holoubek | 705/1 |
| 2008/0177419 | A1 * | 7/2008 | Doyle | 700/221 |

FOREIGN PATENT DOCUMENTS

| | | | |
|---|---|---|---|
| EP | 0406976 | B1 | 10/1995 |
| EP | 0628357 | B1 | 12/1998 |
| EP | 1091327 | A3 | 6/2001 |
| JP | 2002-170075 | A | 6/2002 |
| JP | 2004010331 | | 1/2004 |

* cited by examiner

*Primary Examiner* — Hemant M Desai
(74) *Attorney, Agent, or Firm* — Sughrue Mion, PLLC

(57) ABSTRACT

Prior to assembling mail pieces of which at least a number each comprise a main document and at least one insert of at least one type, one or more mini image files are stored, each defining a mini image of at least a part of a type of insert. The mini image of the respective insert defined by the mini image file is printed on each envelope for a mail piece including that type of insert for one or each of a number of the inserts.

4 Claims, 1 Drawing Sheet

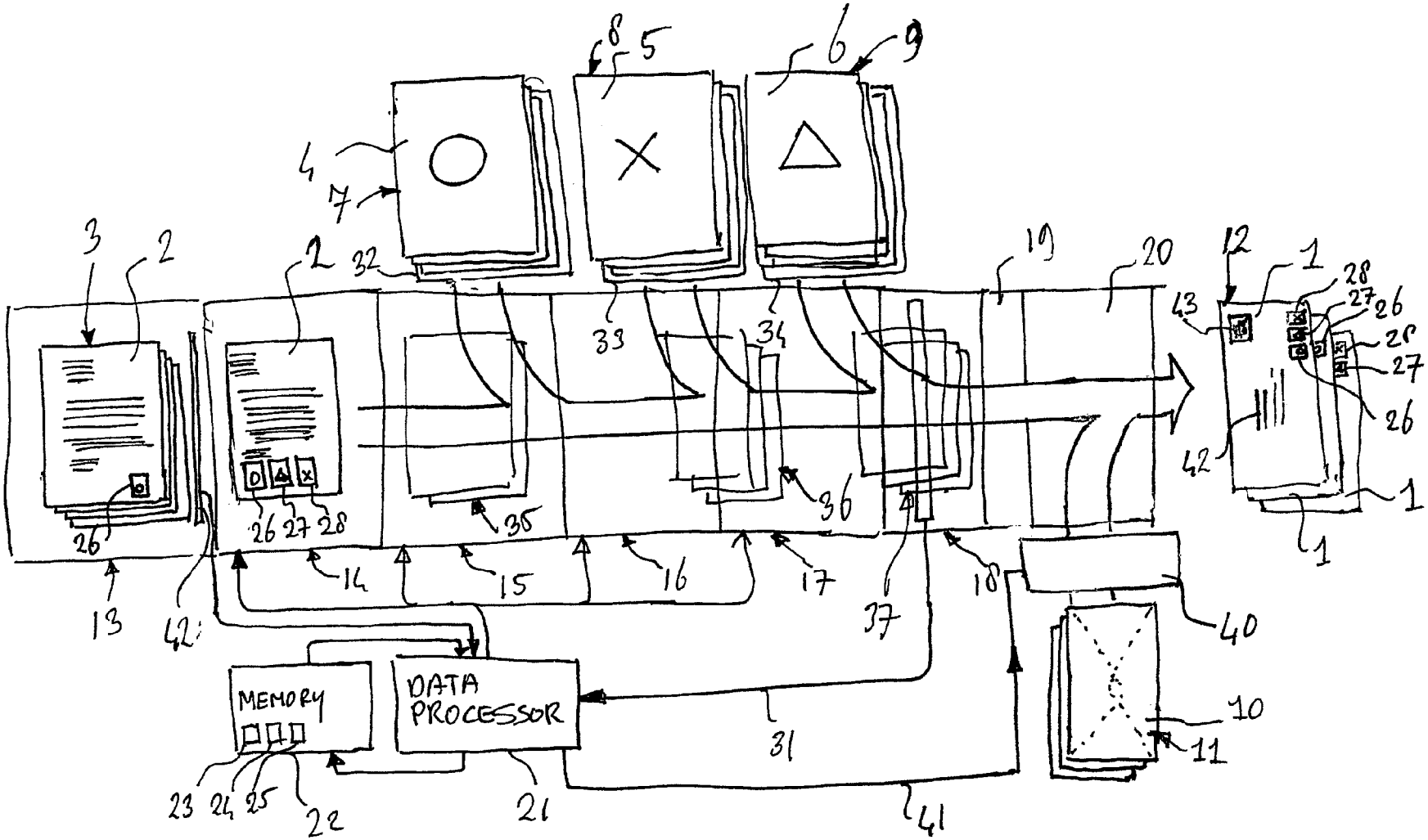
DATA PROCESSOR
MEMORY

APPARATUS FOR ASSEMBLING MAIL PIECES

CROSS REFERENCE OF APPLICATIONS

This is a continuation-in-part application of U.S. patent application Ser. No. 11/026,262, filed Dec. 31, 2004, now abandoned which in turn claims priority to Netherlands Application No. 1025163, filed Dec. 31, 2003, all of which are incorporated herein by reference.

BACKGROUND OF THE INVENTION

The invention relates to a method and an apparatus for assembling mail pieces.

When assembling mail pieces, in most cases, main documents are assembled with inserts such as annexes to form a set, which set is then finished into a mail piece, for instance by inserting the document and the insert or inserts into an envelope.

One objective of (marketing) communication by means of adding inserts is that as much note as possible is taken of these inserts, in particular by persons potentially interested therein. In these and other cases, it is desirable that it is indicated on the envelope which inserts the mail piece contains, so that recipients interested in the respective inserts throw away the mail piece or the inserts less easily.

However, a problem is that it is quite usual for the available types of inserts to vary over time and to include different inserts in mail pieces for different recipients. Therefore, the indications of the inserts are to be logistically geared to the available inserts and the number of inserts to be sent along.

SUMMARY OF THE INVENTION

It is an object of the invention to simplify the provision of indications of inserts included in mail pieces in accordance with available inserts.

According to the invention, this object is achieved by providing a method for assembling mail pieces, of which at least a number each comprise at least one insert of at least one type and an envelope, using an apparatus comprising at least one insert feeder station for individually feeding inserts, and an inserter for inserting inserts into envelopes, the at least one feeder station being arranged for feeding the inserts towards the inserting station. For at least one type of inserts, a mini image file defining a mini image of at least a part of an insert of that type is stored. For each mail piece comprising an insert of that type:

the insert of the that type is fed from the insert feeder station and the insert is transported to the inserting station;

the mini image or mini images defined by the respective mini image file or mini image files are printed on an envelope; and the insert is inserted into the envelope.

The invention also provides an apparatus for assembling mail pieces, including:

at least one insert feeder station for individually feeding inserts, an inserter for inserting inserts into envelopes, the feeder stations being arranged for feeding the inserts towards the inserting station;

a printer for printing on envelopes; and a data processor structure comprising a memory for storing at least one mini image file defining a mini image of at least a part of an insert of a particular type present in the at least one insert feeder station, the data processor structure being arranged for causing the printer to print the at least one mini image defined by the respective at least one mini image file on an envelope for a mail piece if the insert feeder station is controlled to feed an insert of the at least one type for inclusion in the mail piece.

Such an apparatus is specifically designed for carrying out the method according to the invention.

As mini images of an insert of a type, or of inserts of types, that are included in mail-pieces are printed on the envelopes by a printer of the apparatus for assembling mail pieces, the envelopes are provided in a very simple manner with indications of the insert or inserts contained therein and these indications can be determined and geared very simply and flexibly to the inserts to be sent without requiring an understanding of the nature or the contents of the inserts. The provision of the indications regarding the inserts can be made without reference to information on the nature or the meaning of the contents of the inserts.

Further elaborations of the invention are described in the dependent claims.

Further design aspects, effects and details of the invention appear from the detailed description of an exemplary embodiment with reference to the drawing.

BRIEF DESCRIPTION OF THE DRAWINGS

The drawing shows a schematic representation of the process of carrying out an example of a method according to the invention by means of an example of an apparatus for assembling mail pieces.

DETAILED DESCRIPTION OF THE INVENTION

The mail pieces 1 which are assembled according to the example described hereinafter comprise one or more main documents 2 which are individually separated and fed from a stack 3 and inserts 4, 5, 6 in the form of annexes to the main document. The inserts are of three different types which are individually separated and fed from stacks 7, 8, 9, and envelopes 10 which are individually separated and fed from a stack 11. The stacks 3, 7, 8, 9 and 11 are loaded in feeder station holders 32, 33, 34, such as paper cassettes or trays, by a user of the apparatus. The assembled mail pieces 1 are assembled to form a stack 12. The main documents 2 can be identical for all or some of the addressees, in which case the main document effectively constitutes a type of insert itself as well, or be different for each addressee.

The apparatus for assembling mail pieces according to the example represented in the drawing has, as stations, a feeder station 13 for feeding main documents 2 from the stack 3 one by one, a gathering station 14 for gathering main documents to be included in the same mail piece, three insert feeder stations 15, 16, 17, an image capturing device in the form of a scanner 18 and, as finishing stations, a folding station 19 and an inserting station 20 for inserting the assembled sets of documents into envelopes 10 to form the mail pieces 1. It is noted that for the sake of convenient organization, the stacks of documents 7-9 and the stack of envelopes 11 have been depicted next to the insert feeder stations 15-17 and 20 but that as a rule, in practice, they will preferably be located in line with a conveying path extending along or through the stations 13-20. Furthermore, a printer 40 for printing on envelopes 10 fed from the stack 11 is provided and arranged for supplying printed envelopes 10 to the inserting station 19.

The apparatus further has a data processing structure including a data processor 21 for controlling the apparatus and a memory 22 coupled to the data processor 21, so that the data processor 21 can store data in the memory 22 and read data therefrom. The data processor 21 can, for that matter, also be designed as a structure of cooperating processors that can be mounted in a joint housing or, in part or not in part, in separate housings.

The data processor 21 and the memory 22 are designed for storing mini image files 23-25, each defining a mini image of at least a part of an insert 4-6 of a particular type.

The data processor 21 and the printer 40 are arranged for printing one or more mini images 26, 27, 28 defined by one or more of the mini image files 23-25 on each envelope intended for a mail piece with one or more inserts of which at least a portion is shown in the printed mini images. According to the example represented in the drawing, inserts of all three types 4, 5 and 6 have been included in the topmost one of the mail piece 1 in the stack 12 in accordance with the mini images 26, 27, 28 printed on the envelopes.

Accordingly, the insert feeder stations 15, 16, 17, have added a copy of each of the inserts 4, 5, 6 to a main document 2 to form a set. In the drawing, further sets of sheets 35, 36, 37, some of which are not yet complete are also shown.

Finishing the sets of sheets 35, 36, 37 to form mail pieces is carried out, insofar as required, by folding in the folding station 19 and by inserting the completed sets in the inserting station 20.

In this manner, on each envelope 10 for a mail piece 1 with one or more inserts 4, 5, 6 of the three types of inserts loaded in the insert feeder stations 15, 16, 17, one or more mini images 26, 27, 28 defined by the associated mini image files 23, 24, 25 are printed. As mini images of the inserts 4, 5, 6 or parts thereof are used as insert indications, the envelopes can be provided with indications about the inserts (to be) present therein in a very simple manner, in a mail room, and without editing the printing to be made for instance by departments outside the mailroom and without essential knowledge of the contents or nature of the inserts 4, 5, 6. Thus, also in cases in which establishing the inserts to be sent along is not done, at least partly, when the contents of the main documents 2 is/are drafted (as is for instance the case when advertisements are sent along with bills and the like or magazines, or inserts are added to a franking value threshold) the envelopes can be provided with indications relating to the inserts, without editing of the printing being required.

It is possible for the mini image to constitute a full size image of a portion of an insert of the type to be indicated by that mini image. However, in most cases, it is more advantageous to print a an image of an entire insert of a particular type, or of a characterizing part thereof on a reduced scale (i.e. showing an image of the insert or of a portion thereof smaller than the original), because thus, in a relatively reliable manner, a depiction is obtained that fits on the envelope and from which it can be seen more easily what kind of insert is indicated and on the basis of which it can be recognized easily whether the right insert has been inserted, not only by the recipient, but also by a person operating the apparatus. The mini image printed as insert indication can also be a line or part of a line of a text of the respective insert. The mini image printed as insert indication is each time the same for all inserts of a particular insert type. Irrespective whether the mini images constitute images of portions of the annex of the respective type on a reduced scale or not, the mini images as printed are preferably significantly smaller than the inserts, so that several mini images indicating the presence of several types of inserts in the envelope can be printed on an envelope.

The invention can be used in situations in which all mail pieces manufactured during one "run" or "job" are to contain one or more inserts of the same type, but is also particularly suitable for providing insert indications on the envelopes when inserts are to be selectively added to particular main documents, depending on sets of insert instructions associated with a main document. Such insert instructions can for instance appear, by reference or not by reference, from machine-readable signs on the main documents or be presented in synchronization with the feeding of main documents, which is attractive in particular if the main documents are printed in-line, i.e. are fed one by one by the printer that prints the documents, to the stations for assembling mail pieces. According to the present example, the insert instructions on the main documents 2 are also provided in the form of mini images 26, 27, 28, the mini images 26, 27, 28 on the main documents 2 being identical to the mini images 26, 27, 28 that are printed on the respective envelopes 10 into which the main documents 26, 27, 28 and the associated inserts are to be inserted. A scanner 42 for detecting the mini images 26, 27, 28 on the main document is provided and is connected to the data processor 21. The data processor 21 is arranged and connected top the feeder stations 15, 16, 17 for recognizing the mini images 26, 27, 28 and causing the feeder stations 15, 16, 17, to selectively add inserts 4, 5, 6 to the main documents 2 in accordance with mini images 15, 16, 17 present on the respective main documents 2.

For printing on the envelopes 10, automatically and selectively, only those mini images 26, 27, 28 are printed that correspond with the insert types which, according to the insert instructions, are to be added to the respective main document are printed on the respective envelopes. This can be achieved in a particularly simple manner by printing the mini images as scanned from the main documents 2. For obtaining a high quality printing, it is preferred that the printings on the envelopes 10 are defined on the basis of a mini image files associated to the same selected inserts 4, 5 and 6 as the mini images scanned from the respective main document 2.

When assembling the mail pieces 1, in accordance with the insert instructions, the mini image files 23-25 are selected which are identified by the indications of the types of insert 4-6 which, according to the insert instructions, are to be included in the same mail piece as the main document 2 with which the insert instructions are associated. If only one or no insert is to be added to some of the main documents, one or no mini image file 23-25 is selected.

Thus, the data processor 21 ensures that the printer 40 is controlled for exclusively printing the mini images 26-28 that are defined by the selected mini image files 23-25 on the envelopes 10 and the insert feeder stations 15-17 are controlled for selectively including inserts 4-6 exclusively in mail pieces in which inserts of the selected type or types are to be included according to the insert instructions.

Printing the envelopes can be carried out prior to or after the associated documents and inserts have been inserted therein. In the present example, the envelopes are printed by the printer 40 and supplied to the inserting station 20 one by one. Thus, matching of envelopes 10 with the main document 2 and the inserts 4, 5, 6, if any, can be achieved and maintained in a simple manner.

The data processor 21 is coupled to the scanner 18 via a connection 31 and arranged for converting image data obtained upon scanning into the mini image files 23-25. As the mini image files 23-25 are obtained by scanning the inserts 4-6 of the respective types, it is ensured in a simple manner that the correct representations 26-28 are printed on the main documents 2, without it being required that mini image files 23-25, or information on the basis of which these can be assembled, are supplied.

According to this example, further, the scanner 18 is located downstream of the holders 32-34 of the insert feeder stations 15-17 for dispensing the inserts 4-6 one by one. The data processor 21 is further designed for controlling the insert feeder stations 15-17 for feeding, during a start-up phase, a sample of each of the inserts 4-6 from the holders 32-34, and receiving image data obtained upon scanning of the insert 4-6 of the types loaded in the insert feeder stations 15-17, processing the image data into image data files 23-25 and storing the mini image files 23-25, each in association with at least one insert feeder station code of the insert feeder station 15-17, which insert feeder station code indicates to which of the insert feeder stations 15-17 the mini image file belongs.

In this manner, the mini image files 23-25 are not only obtained during scanning, but what is also achieved during the start-up phase prior to the operational phase is that the mini image files 23-25 are automatically coupled to the insert feeder stations 15-17 in which the respective insert types 4-6 have been loaded. When, in operation, the insert instructions indicate, for instance, that inserts 4, 5 are to be added to a particular main document, on the basis of the insert instructions, also the mini image files with the codes identifying the first two insert feeder stations 15, 16 are selected, resulting in the printing of the mini images 26, 28 of the inserts 4, 5 in the first two insert feeder stations 15, 16.

However, the mini image files can also be obtained in many different manners, for instance from the designer or printer of the respective insert. During a start-up phase preceding an operational phase during which mail pieces are assembled, the scanner 18 can be utilized for recognizing which types of inserts are present in the feeder stations 15, 16, 17. When the mini image files 23-25 are stored in association with indications referring to associated insert types, it can automatically be ensured that the correct inserts are added and the correct mini image files are printed.

When the scanner 18 is used only during the start-up phase, it is advantageous to design it to be removable. A relatively slow scanner then suffices, scanning the inserts only during the start-up phase, because during the operational phase, the documents and inserts do not need to be led through the scanner.

The inserts can also be printed in reaction to insert instructions which refer to particular types of inserts, while each time, those mini image files for determining the mini images to be printed on the envelopes are selected that belong to the insert types indicated by the insert instructions.

Within the framework of the invention, many other modes and embodiments of carrying out the invention are conceivable. For instance, instead of annexes to a main documents, the insert or inserts may also constitute the only contents of the envelope. Furthermore, instead of a scanner, also other image capturing devices can be used, such as a camera.

What is claimed is:

1. An apparatus for assembling mail pieces, comprising:

at least one insert feeder station for individually feeding inserts, an inserter for inserting inserts into envelopes, the feeder station being arranged for feeding the inserts towards the inserting station;

a printer for printing on envelopes; and a data processing structure comprising a data processor and a memory for storing at least one mini image file defining a mini image of at least a part of an insert of a particular type present in the at least one insert feeder station, the data processor structure being arranged for causing the printer to print the at least one mini image defined by the respective at least one mini image file on an envelope for a mail piece if the insert feeder station is controlled to feed an insert of said at least one type for inclusion in said mail piece.

2. An apparatus according to claim 1, wherein the data processor structure is further arranged for:

storing the at least one mini image file in association with an indication identifying the respective type of insert;

selecting for each of at least a number of the mail pieces, in accordance with associated ones of the insert instructions which selectively define inserts for the mail pieces, at least one of the mini image files identified by the at least one indication of the at least one type of insert which, according to the insert instructions, is intended for that mail piece;

controlling the printer for printing exclusively those representations which are defined by the at least one selected mini image file; and controlling the at least one insert feeder station for selectively adding, in accordance with the insert instructions, inserts of the type loaded in this insert feeder station exclusively for the mail pieces for which, according to the insert instructions, inserts of this type are intended.

3. An apparatus according to claim 2, further comprising a scanner image capturing device for capturing an image of at least a part of at least one insert of a particular type; the data processor structure being further designed for converting image data obtained upon capturing the image into at least one of said mini image files.

4. An apparatus according to claim 3, wherein the image capturing device is located downstream of a holder of an insert feeder station for individually feeding inserts for a set of sheets to be processed to form a mail piece and wherein the data processor structure is further arranged for controlling the insert feeder station for, during a start-up phase, individually feeding an insert, receiving image data obtained upon capturing the image from the insert and storing at least one mini image file in association with at least one insert feeder station code which indicates the insert feeder station from which the insert from which the image was captured was fed and to which the mini image file is associated.

* * * * *